US008215719B2

(12) United States Patent
Kelly et al.

(10) Patent No.: US 8,215,719 B2
(45) Date of Patent: Jul. 10, 2012

(54) ROTATABLE CUTTING TOOL WITH THROUGH COOLANT

(75) Inventors: Adam Joseph Kelly, Altoona, PA (US); Chad Allen Swope, Bedford, PA (US)

(73) Assignee: Kennametal Inc., Latrobe, PA (US)

( * ) Notice: Subject to any disclaimer, the term of this patent is extended or adjusted under 35 U.S.C. 154(b) by 328 days.

(21) Appl. No.: 12/574,091

(22) Filed: Oct. 6, 2009

(65) Prior Publication Data

US 2011/0080037 A1 Apr. 7, 2011

(51) Int. Cl.
*E21C 35/22* (2006.01)

(52) U.S. Cl. ..... 299/81.1; 299/111

(58) Field of Classification Search ..... 299/111, 299/81.1, 81.3

See application file for complete search history.

(56) References Cited

U.S. PATENT DOCUMENTS

| | | | | |
|---|---|---|---|---|
| 4,251,109 | A * | 2/1981 | Roepke | 299/81.3 |
| 4,405,178 | A * | 9/1983 | Brandenburg | 299/81.2 |
| 4,453,775 | A * | 6/1984 | Clemmow | 299/81.1 |
| 4,456,306 | A | 6/1984 | Wrulich et al. | |
| 4,583,786 | A * | 4/1986 | Thorpe et al. | 299/81.3 |
| 4,705,321 | A | 11/1987 | Hedlund | |
| 4,765,686 | A * | 8/1988 | Adams | 299/81.1 |
| 5,941,664 | A | 8/1999 | Morsch | |
| 6,354,771 | B1 * | 3/2002 | Bauschulte et al. | 299/111 |
| 7,125,207 | B2 | 10/2006 | Craig et al. | |
| 2009/0256413 | A1 * | 10/2009 | Majagi et al. | 299/111 |

* cited by examiner

*Primary Examiner* — John Kreck
(74) *Attorney, Agent, or Firm* — Matthew W. Smith, Esq.

(57) ABSTRACT

A rotatable cutting tool for use in impinging earth strata such as, for example, asphaltic roadway material, coal deposits, mineral formations and the like. The rotatable cutting tool includes a cutting tool body having a through coolant channel and a two-piece head portion, e.g., the head portion of the cutting tool body having a base portion and a nose portion with a hard tip cutting insert affixed to the nose portion. The through coolant provides for cooling the hard tip cutting insert during operation of the cutting tool. In addition, the through coolant also provides for suppressing dust created by the rotatable cutting tool during operation.

13 Claims, 3 Drawing Sheets

ROTATABLE CUTTING TOOL WITH THROUGH COOLANT

BACKGROUND OF THE INVENTION

The invention pertains to a rotatable cutting tool that is useful for the impingement of earth strata such as, for example, asphaltic roadway material, coal deposits, mineral formations and the like. More specifically, the present invention pertains to a rotatable cutting tool that is useful for the impingement of earth strata wherein the cutting tool body possesses improved design so as to provide for improved performance characteristics for the rotatable cutting tool.

Rotatable cutting tools have been used to impinge earth strata such as, for example, asphaltic roadway material or ore bearing or coal bearing earth formations or the like. Generally speaking, these kinds of rotatable cutting tools have an elongate cutting tool body typically made from steel and a hard tip (or insert) affixed to the cutting tool body at the axial forward end thereof. The hard tip is typically made from a hard material such as, for example, cemented (cobalt) tungsten carbide. The rotatable cutting tool is rotatably retained or held in the bore of a tool holder or, in the alternative, in the bore of a sleeve that is in turn held in the bore of a holder.

The holder is affixed to a driven member such as, for example, a driven drum of a road planing machine. In some designs, the driven member (e.g., drum) carries hundreds of holders wherein each holder carries a rotatable cutting tool. Hence, the driven member may carry hundreds of rotatable cutting tools. The driven member is driven (e.g., rotated) in such a fashion so that the hard tip of each one of the rotatable cutting tools impinges or impacts the earth strata (e.g., asphaltic roadway material) thereby fracturing and breaking up the material into debris.

As can be appreciated, during operation the rotatable cutting tool and the cutting insert are typically subjected to a variety of extreme cutting forces and stresses in an abrasive and erosive environment. In addition, during a machining operation the cutting insert becomes heated. The heat spreads quickly through the cutting insert. The cutting insert reaches, in a very short time, a range of temperatures within which the resistance to plastic deformation of the cutting insert material decreases. When large cutting forces act on the cutting insert, this phenomenon entails a risk that the cutting insert will be subject to plastic deformation, in particular, in the proximity of the cutting edge, where insert breakage can result. In order to diminish the risk of plastic deformation, an efficient system for cooling the cutting insert would be desirable, whereby the working temperature of the insert can be regulated within desired limits.

As is also known during use of the rotatable cutting tool, a substantial amount of dust may be generated, e.g. coal dust during a mining operation. When the dust becomes air borne, it becomes a risk for humans and equipment in the immediate area. For example, the dust can be inhaled by humans (health risk) or the dust can be ignited by mining activities causing an explosion (safety risk). In order to reduce or minimize health and/or safety risks, an efficient system that reduces or minimizes the amount of dust that is generated would be desirable.

The present invention has been developed in view of the foregoing.

SUMMARY OF THE INVENTION

The present invention provides a rotatable cutting tool for use in impinging earth strata such as, for example, asphaltic roadway material, coal deposits, mineral formations and the like. The rotatable cutting tool includes a cutting tool body having a through coolant channel and a two-piece head portion, e.g., the head portion of the cutting tool body includes a base portion and a nose portion with a hard tip cutting insert affixed to the nose portion. The through coolant provides for cooling the hard tip cutting insert during operation of the cutting tool. In addition, the through coolant also provides for suppressing dust created by the rotatable cutting tool during operation.

An aspect of the present invention is to provide a rotatable cutting tool for use in impinging earth strata wherein the rotatable cutting tool comprises a cutting tool body and a hard tip affixed to the cutting tool body. The cutting tool body includes an axial forward end for receiving the hard tip and an axial rearward end, a head portion axially rearward of the axial forward end, a collar portion axially rearward of the head portion and a shank portion axially rearward of the collar portion and axially forward of the axial rearward end. The head portion includes a base portion affixed to the collar portion and a nose portion movably connected to the base portion. The cutting tool body defines an internal coolant channel extending axially from the axial rearward end through the shank portion, the collar portion and through at least part of the base portion of the head portion. The nose portion of the head portion is positioned adjacent to the internal coolant channel that extends through the base portion of the head portion. In one aspect of the invention, the base portion defines a pocket for receiving at least a part of the nose portion. In another aspect of the invention, the pocket is in fluid communication with the internal coolant channel. In yet another aspect of the invention, the nose portion includes at least one flute formed on a surface thereof.

Another aspect of the present invention is to provide a rotatable cutting tool for use in impinging earth strata wherein the rotatable cutting tool comprises a cutting tool body and a hard tip affixed to the cutting tool body. The cutting tool body includes an axial forward end for receiving the hard tip and an axial rearward end, a head portion axially rearward of the axial forward end, a collar portion axially rearward of the head portion and a shank portion axially rearward of the collar portion and axially forward of the axial rearward end. The head portion includes a base portion that defines a pocket, wherein the head portion further includes a nose portion that is at least partially received in the pocket of the base portion and is rotatably connected to the base portion. The cutting tool body defines a coolant channel that is in fluid communication with the pocket of the base portion. In one aspect, the nose portion defines at least one rotational flute.

A further aspect of the present invention is to provide a rotatable cutting tool body with a central longitudinal axis, the rotatable cutting tool body comprising a head portion, a shank portion, and a collar portion mediate of and contiguous with the head portion and the shank portion. The head portion includes a base portion and a nose portion. The cutting tool body further comprises an axial forward end adjacent to the nose portion of the head portion and an axial rearward end adjacent to the shank portion. Means for rotatably connecting the nose portion to the base portion are provided. The cutting tool body also comprises an internal coolant channel extending axially from the axial rearward end through the shank portion, the collar portion, and through at least a portion of the head portion. In one aspect of the invention, the nose portion of the head portion is positioned adjacent an axial forward end of the internal coolant channel that extends through at least a part of the head portion. In another aspect, the base portion defines a pocket for receiving at least a part of the nose portion. In yet another aspect of the invention, the pocket is in fluid communication with the internal coolant channel. In another aspect of the invention, the nose portion includes at least one rotational flute formed on a surface thereof.

These and other aspects of the present invention will be more fully understood following a review of this specification and drawings.

DETAILED DESCRIPTION

As used herein, the term "coolant" generally refers to any liquid, gas, or other material that is suitable for use with the present invention as described herein. In one aspect, the coolant may be a liquid such as, for example, water. In another aspect, the coolant may be, for example, an air-water mixture, oil, or carbon dioxide.

Figure 1:
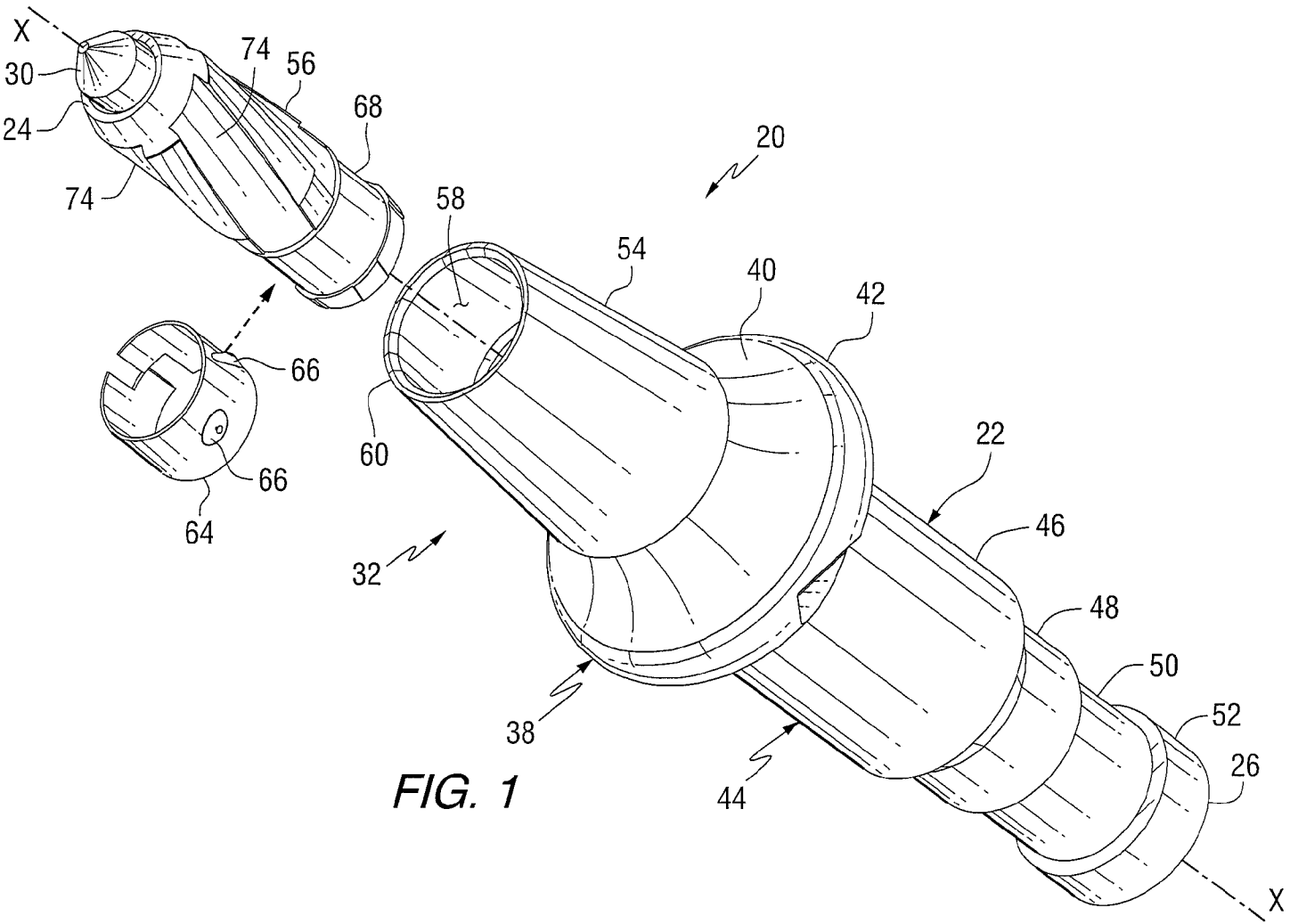
FIG. 1 is an exploded, perspective view of a rotatable cutting tool, in accordance with an aspect of the invention.
Figure 2:
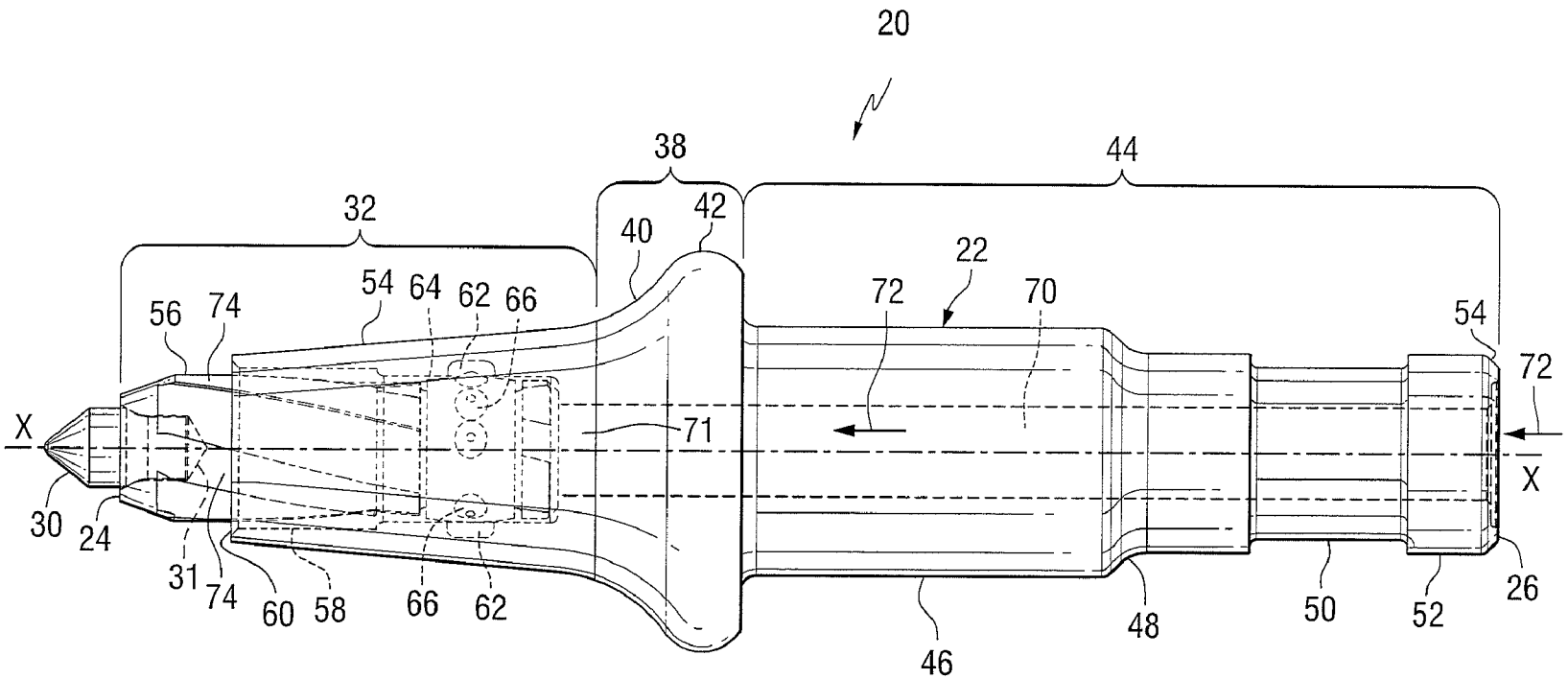
FIG. 2 is a side elevational view of the rotatable cutting tool, shown in FIG. 1, as assembled, in accordance with an aspect of the invention.

Referring to FIGS. 1 and 2, there is illustrated a rotatable cutting tool, generally designated as 20, in accordance with an aspect of the invention. Rotatable cutting tool 20 comprises an elongate cutting tool body, generally designated as 22. The cutting tool body 22 is typically made of steel such as those grades disclosed, for example, in U.S. Pat. No. 4,886,710 to Greenfield, which is hereby incorporated by reference.

Still referring to FIGS. 1 and 2, the cutting tool body 22 has an axial forward end 24 and an axial rearward end 26. A hard tip or insert 30 is affixed (such as by brazing or the like) in a socket 31 in the axial forward end 24 of the cutting tool body 22. Hard insert 30 is typically made from cemented carbide such as, for example, cemented (cobalt) tungsten carbide wherein U.S. Pat. No. 6,375,272 to Ojanen, which is hereby incorporated by reference, discloses examples of acceptable grades of cemented (cobalt) tungsten carbide. The geometry of the hard insert 30 can vary depending upon the specific application. U.S. Pat. No. 6,375,272 to Ojanen discloses an exemplary geometry for the hard insert. It should be appreciated that as an alternative to the socket, the axial forward end of the cutting tool body may present a projection that is received within a socket in the bottom of the hard tip. This alternate structure can be along the lines of that disclosed, for example, in U.S. Pat. No. 5,141,289 to Stiffler, which is hereby incorporated by reference.

The cutting tool body 22 is divided into three principal portions; namely, a head portion 32, a collar portion 38 and a shank portion 44. These portions will now be described.

The most axial forward portion is the head portion 32. The head portion 32 begins at the axial forward end 24 and extends along longitudinal axis X-X in the axial rearward direction.

The mediate portion is the collar portion 38. Beginning at the juncture with the head portion 32 and extending along the longitudinal axis X-X in the axial rearward direction, the collar portion 38 comprises a tapered neck section 40 followed by a cylindrical collar section 42.

The most axial rearward portion is the shank portion 44. Beginning at the juncture with the collar portion 38 and extending along the longitudinal axis X-X in the axial rearward direction, the shank portion 44 comprises a forward cylindrical tail section 46, followed by a mid-section 48, followed by a retainer groove 50, followed by a rearward cylindrical tail section 52 and terminating in a beveled section 54. As is known by those skilled in the art, the shank portion 44 is the portion of the cutting tool body 22 that carries the retainer (not illustrated). The retainer rotatably retains the rotatable cutting tool in the bore of a tool holder (not illustrated) or the bore of the sleeve carried by a holder. While the retainer can take on any one of many geometries, a retainer suitable for use with this cutting tool body is shown and described, for example, in U.S. Pat. No. 4,850,649 to Beach et al., which is hereby incorporated by reference.

Still referring to FIGS. 1 and 2, the head portion 32 includes a two-piece construction, in accordance with an aspect of the invention. Specifically, the head portion 32 includes a base portion 54 that is affixed to the collar portion 38. The head portion 32 also includes a nose portion 56 that is movably connected to the base portion 54. In one aspect of the invention, the hard tip 30 is affixed to the nose portion 56.

As illustrated in FIGS. 1 and 2, the base portion 54 of the head portion 32 defines a pocket, generally designated by reference no. 58. In one aspect, the pocket 58 can have a substantially circular cross-section and extend axially along axis X-X from an axial forward end 60 of the base portion 54 rearwardly toward the collar portion 38. A groove 62 (see FIG. 2) is formed in the base portion 54 circumferentially about the pocket 58.

At least a part of the nose portion 56 is received in the pocket 58. The nose portion 56 is movably connected to the base portion 54. In one aspect of the invention, the movable connection is provided by a mounting clip 64, e.g., a spring clip that is attached to the nose portion 56 and includes a plurality of dimples 66 that are received in the groove 62. The mounting clip 64 is retained on the nose portion 56 by positioning the mounting clip 64 in an elongated notch 68 formed circumferentially about the nose portion 56. In one aspect of the invention, the described configuration of the mounting clip 64 with dimples 66 that cooperate with groove 62 provides for the nose portion 56 to be rotatably connected to the base portion 54. Thus, it will be appreciated that the nose portion 56 is allowed to move independently with respect to the base portion 54. In addition, it will be appreciated that other means for movably connecting the nose portion 56 to the base portion 54 may be provided in accordance with the scope of the invention.

Figure 3:
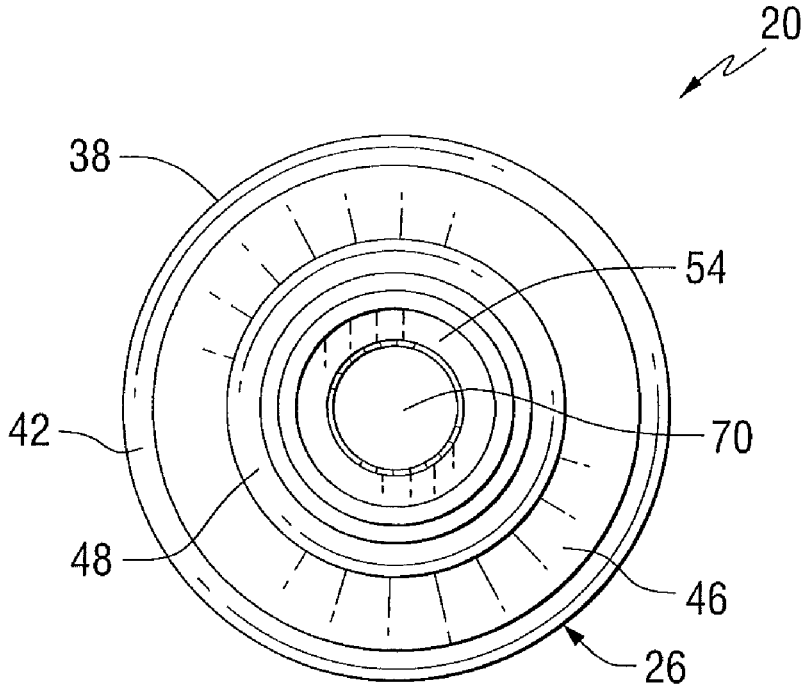
FIG. 3 is an end elevational view of the rotatable cutting tool shown in FIGS. 1 and 2, in accordance with an aspect of the invention.

Referring to FIGS. 2 and 3, the cutting tool body 22 defines a coolant channel 70 that extends axially along axis X-X from the axial rearward end 26 through the shank portion 44, through the collar portion 38, and through at least part of the base portion 54 of the head portion 32. In one aspect of the invention, the coolant channel 70 has a substantially circular cross-section. In another aspect of the invention, the coolant channel 70 is formed on an internal portion of the cutting tool body 22 and an axial forward end 71 of the coolant channel 70 is in fluid communication with the pocket 58 of the base portion 54. This configuration provides for the nose portion 56 of the head portion 32 to be positioned adjacent to the internal coolant channel 70 that extends through at least a part of the base portion 54 of the head portion 32.

In operation of the rotatable cutting tool 20 of the invention, a coolant is passed through the internal coolant channel 70 in the direction indicated by arrows 72. The coolant passes from the coolant channel 70 to the pocket 58 of the base portion 54. Once the coolant reaches the pocket 58, the coolant is able to contact the nose portion 56 which, as described, is movably mounted within the base portion 54. It will be appreciated, therefore, that due to the nose portion 56 being movably connected relative to the base portion 54, that the nose portion 56 does not have a snug or interference fit that would prevent the coolant from passing over the nose portion 56 and moving toward the axial forward end 60 of the base portion 54. Once the coolant passes the axial forward end 60 of the base portion 54, it continues to flow toward the axial forward end 24 of the nose portion 56 and toward the hard tip cutting insert 30. Advantageously, the coolant provides for cooling the hard tip 30 during a cutting operation of the rotatable cutting tool 20. This provides for the working temperature of the hard tip 30 to be regulated within desired limits during a cutting operation in order to increase the useful life of the hard tip 30.

In addition, it will be appreciated that providing for the coolant to pass through the cutting tool body 22 and reach an axial forward end 24 thereof, provides for the coolant to act as a dust suppressant for dust that may be generated during a particular cutting operation using the rotatable cutting tool 20.

As shown in FIGS. 1 and 2, the nose portion 56 may have one or more flutes 74 formed on a surface of the nose portion 56, in accordance with an aspect of the invention. Advantageously, the flutes 74 provide for the coolant that contacts the nose portion 56 to engage the flutes 74 and to rotate the nose portion 56 with respect to the base portion 54. The increased rotation of the nose portion 56 due to the flutes 74 interacting with the coolant provides for increased life for the hard tip 30 by providing for more uniform wear of the hard tip 30.

Figure 4:
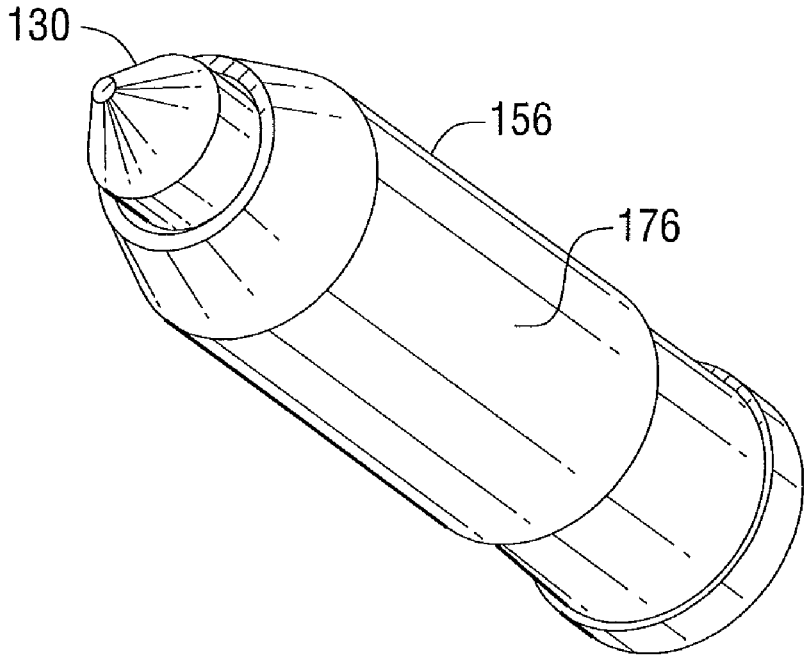
FIG. 4 is a nose portion of a rotatable cutting tool, in accordance with an aspect of the invention.

FIG. 4 illustrates an alternate embodiment of a nose portion 156, in accordance with an aspect of the invention. Nose portion 156 includes a hard tip 130 affixed thereto, similar to the arrangement set forth and described herein in FIGS. 1 and 2. However, the nose portion 156 includes a substantially smooth outer surface 176, i.e., the outer surface 176 does not include flutes formed thereon. The nose portion 156 is still rotatably mounted with respect to a base portion (not shown in FIG. 4) to provide for relative movement between the nose portion 156 and the corresponding base portion.

Whereas particular embodiments of this invention have been described above for purposes of illustration, it will be evident to those skilled in the art that numerous variations of the details of the present invention may be made without departing from the invention as defined in the appended claims.

What is claimed is:

1. A rotatable cutting tool for use in impinging earth strata, the rotatable cutting tool comprising:

a cutting tool body;

a hard tip affixed to the cutting tool body;

the cutting tool body having an axial forward end for receiving the hard tip and an axial rearward end, a head portion axially rearward of the axial forward end, a collar portion axially rearward of the head portion, and a shank portion axially rearward of the collar portion and axially forward of the axial rearward end;

the head portion including a base portion affixed to the collar portion and a nose portion movably connected to the base portion, wherein the base portion defines a pocket for receiving at least a part of the nose portion;

the cutting tool body defining an internal coolant channel extending axially from the axial rearward end through the shank portion, the collar portion and at least part of the base portion of the head portion, wherein the nose portion of the head portion is positioned adjacent to the internal coolant channel that extends through the base portion of the head portion; and a mounting clip attached to the nose portion and a groove formed in the base portion circumferentially about the pocket, wherein the mounting clip cooperates with the groove to provide the movable connection between the nose portion and the base portion.

2. The rotatable cutting tool of claim 1, wherein the hard tip is affixed to the nose portion.

3. The rotatable cutting tool of claim 1, wherein the pocket is in fluid communication with the internal coolant channel.

4. The rotatable cutting tool of claim 1, wherein the nose portion includes at least one flute formed on a surface thereof.

5. The rotatable cutting tool of claim 1, wherein the internal coolant channel has a substantially circular cross-section.

6. A rotatable cutting tool for use in impinging earth strata, the rotatable cutting tool comprising:

a cutting tool body;

a hard tip affixed to the cutting tool body;

the cutting tool body having an axial forward end for receiving the hard tip and an axial rearward end, a head portion axially rearward of the axial forward end, a collar portion axially rearward of the head portion, and a shank portion axially rearward of the collar portion and axially forward of the axial rearward end;

the head portion including a base portion that defines a pocket, the head portion further including a nose portion that is at least partially received in the pocket of the base portion and is rotatably connected to the base portion; and the cutting tool body defining a coolant channel that is in fluid communication with the pocket of the base portion.

7. The rotatable cutting tool of claim 6, wherein the nose portion defines at least one rotational flute.

8. A rotatable cutting tool body with a central longitudinal axis, the rotatable cutting tool body comprising:

a head portion, a shank portion, and a collar portion mediate of and contiguous with the head portion and the shank portion, the head portion including a base portion and a nose portion;

an axial forward end adjacent to the nose portion of the head portion and an axial rearward end adjacent to the shank portion;

means for rotatably connecting the nose portion to the base portion; and an internal coolant channel extending axially from the axial rearward end through the shank portion, the collar portion and at least part of the head portion.

9. The rotatable cutting tool body of claim 8, wherein the nose portion of the head portion is positioned adjacent an axial forward end of the internal coolant channel that extends through at least part of the head portion.

10. The rotatable cutting tool body of claim 8, wherein the base portion defines a pocket for receiving at least a part of the nose portion.

11. The rotatable cutting tool body of claim 10, wherein the pocket is in fluid communication with the internal coolant channel.

12. The rotatable cutting tool body of claim 10, wherein the means for rotatably connecting the nose portion to the base portion includes a mounting clip attached to the nose portion and a groove formed in the base portion circumferentially about the pocket, wherein the mounting clip cooperates with the groove to provide the rotatable connection between the nose portion and the base portion.

13. The rotatable cutting tool body of claim 8, wherein the nose portion includes at least one rotational flute formed on a surface thereof.

* * * * *